US005666021A

United States Patent [19]

Myson

[11] Patent Number: 5,666,021

[45] Date of Patent: Sep. 9, 1997

[54] LAMP HOLDER

[75] Inventor: Robert Ernest Myson, Ingatestone, United Kingdom

[73] Assignee: Luminaire Developments Limited, Channel Islands

[21] Appl. No.: 574,266

[22] Filed: Dec. 18, 1995

Related U.S. Application Data

[62] Division of Ser. No. 304,088, Sep. 9, 1994, Pat. No. 5,562, 481.

[30] Foreign Application Priority Data

Sep. 10, 1993 [GB] United Kingdom ..... 9318824

[51] Int. Cl.[6] ..... H01J 5/48; H01J 5/50

[52] U.S. Cl. ..... 313/318.1; 313/318.01; 362/249

[58] Field of Search ..... 313/318.01, 318.02, 313/318.07, 318.09, 318.1; 362/249, 226, 252, 806; 439/602

[56] References Cited

U.S. PATENT DOCUMENTS

| | | | |
|---|---|---|---|
| 4,057,718 | 11/1977 | Svensson | 362/249 |
| 4,385,257 | 5/1983 | Fitzgerald | 313/318.01 |
| 4,569,005 | 2/1986 | Bergin et al. | 362/267 |
| 4,807,098 | 2/1989 | Ahroni | 362/249 |
| 5,161,881 | 11/1992 | Myson | 362/249 |
| 5,234,356 | 8/1993 | Maejima et al. | 439/352 |
| 5,366,386 | 11/1994 | Liao | 439/419 |

FOREIGN PATENT DOCUMENTS

| | | | |
|---|---|---|---|
| 470036 | 12/1950 | Canada | 439/419 |
| 0090502 | 10/1983 | European Pat. Off. | H01R 13/627 |
| 0422117 | 2/1994 | European Pat. Off. | H01R 25/14 |

*Primary Examiner*—Michael Horabik
*Assistant Examiner*—Michael Day
*Attorney, Agent, or Firm*—Gunn, Lee & Miller, P.C.

[57] ABSTRACT

A lamp holder includes a base and two electrical contacts for forming a connection with a bulb having an envelope around an electrical filament having two wires extending therefrom. Each wire forms a loop protruding from the envelope, the two loops being at opposed ends of the envelope. Each electrical contact of the lamp holder has a wire with a hook at its free end and formed to engage one of the two loops of the bulb, so that a shorter one of the wires engages the one of said two loops at the nearer end of the bulb and the other larger spring wire engages the other of said two loops at the far end of the bulb, in a manner that induces a spring tension in the wire. Thus, the bulb is held suspended between, and in electrical contact with, the two loops.

6 Claims, 4 Drawing Sheets

LAMP HOLDER

This application is a divisional application of U.S. patent appliction Ser. No. 08/304,088, filed Sep. 9, 1994, now U.S. Pat. No. 5,562,481.

FIELD OF THE INVENTION

This invention relates to a festoon lamp holder, and to a fighting system incorporating such a lamp holder.

BACKGROUND TO THE INVENTION

Our European Patent EP-B-0 422 117 discloses a lamp holder which is arranged to be secured to a cable in such a manner as to be a permanent fitting and to give a pressure-tight seal to the cap enclosing the connection to the cable. The lamp holder is thus resistant to tampering and vandalism, and has a very long service life, because the problems arising from corrosion due to moisture ingress do not arise.

The lamp holder comprises a base and a cap, the base having a pair of part-circular lugs upstanding therefrom with outwardly facing detents which engage with a continuous groove around the inner surface of the cap. The locking or retaining surfaces of the groove and the detent extend in a plane normal to the axis of symmetry of the cap, so that there is no tendency for the surfaces to cam apart if an attempt is made to prise the cap from the base. This ensures permanency in the fitting of the cap to the base, but it makes the manufacture of the caps difficult, because conventional plastics molding techniques do not readily permit the formation in such a confined space of the retaining surface which is normal to the direction of withdrawal of an internal molding tool. Thus, it has been necessary to machine the recess into the inner surface of the cap after molding, and this adds significantly to the cost of manufacture.

To permit the groove to be formed during molding of the cap, the surface of the groove engaged by the detents is preferably oblique to the axis of symmetry of the cap, for example at 45°, % with the corresponding surface of the detent being similarly angled. However, while the cap is still difficult to remove from the base when the components are formed in this way, it has been found that removal is possible, for example by levering the cap off with a screwdriver. One aspect of the present invention seeks to provide an arrangement in which a wholly molded cap can still be permanently locked on to the base.

Certain types of long-life low voltage lamps are presented as a festoon lamp having a generally cylindrical envelope with an electrical connection at each end. The electrical connection consists, in one form of lamp, in a wire loop extending from each end of the quartz or glass envelope. Such lamps are intended to fit into low profile reflector holders having a sprung connector at one or both ends which bears against the wire loop to make the electrical contact, the lamp being held lengthways in line with the base. It is desirable to be able to use such lamps in low voltage lighting systems in accordance with the invention, since they would reduce still further the maintenance required. However, it is necessary for the light to be emitted in all directions, rather than simply through substantially 2 $\pi$ radians as occurs in a flat reflector light with which such lamps are normally associated.

Another aspect of the invention provides a lamp holder which permits such lamps to be held perpendicular to the base, allowing light to be radiated through substantially 4 $\pi$ radians.

SUMMARY OF THE INVENTION

According to a first aspect of the invention there is provided a lamp holder comprising a base having electrical contacts for a lamp on one side thereof connected to a pair of upstanding probes on the other side thereof, the base also having a plurality of lugs upstanding therefrom with outwardly projecting detents engageable in an internal groove in a substantially non-deformable cap, the cap having therein retaining means engageable with the lugs when the cap is fitted on to the base to prevent inward deflection of the lugs when the cap is fully engaged on the base, thereby ensuring that the cap is permanently secured to the base.

The probes may preferably be located in a channel extending across the base and arranged to receive a cable therein. The base and cap may preferably be circular in plan for which the base may comprise a pair of part circular lugs, each with a detent, and with the retaining means suitably formed as a plurality of segments of a circle, preferably cruciform in plan, rather than a solid element.

Preferably, the cap and the base co-operate to form a pressure-tight seal therebetween, sufficient to resist the excess pressure within the cap due to changes in temperature during use of the lamp.

The second aspect of the invention provides a lamp holder for a lamp of the type having an elongate envelope containing an electrical filament and with a wire loop at each end thereof, the lamp holder comprising a base having a pair of electrical contacts upstanding therefrom, the first of the contacts being in the form of a spring wire projecting substantially further from the base than the second contact, each contact terminating in a hook, whereby one loop on the lamp is engaged with the hook on the second contact and the first contact is bent over to engage its hook with the other loop on the lamp, the spring wire holding the lamp under tension between the hooks.

The invention also provides a festoon lighting system comprising a plurality of lamp holders attached to and spaced apart along an insulated electrical supply cable, each of the lamp holders being in accordance with one aspect of the invention.

BRIEF DESCRIPTION OF THE DRAWINGS

In the drawings, which illustrate lamp holders according to exemplary embodiments of the invention.

DETAILED DESCRIPTION OF THE ILLUSTRATED EMBODIMENT

Figure 1:
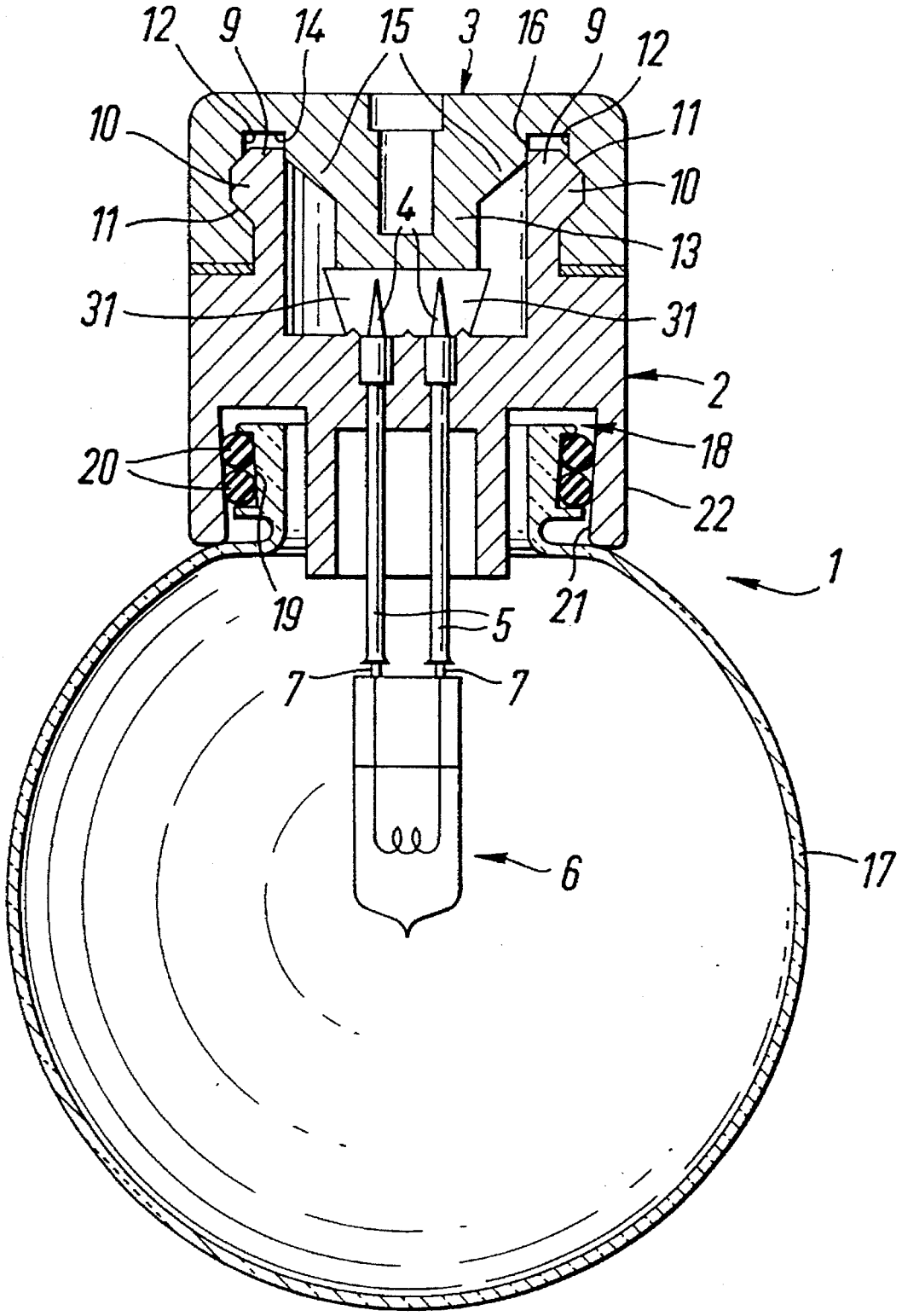
FIG. 1 is a cross sectional elevation of a lamp holder according to a first embodiment of the invention.

Referring to FIG. 1, the illustrated lamp holder 1 is for use in low voltage festoon lighting, for example of the type disclosed in EP-B-0 422 117, and comprises a base 2 of circular plan to which is permanently fitted a cap 3. The base has a pair of contact pins 4 extending therethrough and providing tubular contacts 5 for a low voltage tungsten halogen lamp 6 whose contact leads 7 are crimped to engage and hold in the tubular contacts 5. The contact pins pierce the synthetic rubber insulation of a trapezoidal section cable 8 to make electrical contact with the cores therein, the cable locating into and passing through corresponding trapezoidal recesses or channels 31 on each side of the base 2, as described in EP-B-0 422 117.

The base 2 has a pair of part-circular lugs 9 upstanding therefrom, the lugs each having an external detent 10 which engages in a corresponding recess or groove 11 formed around the internal surface of the side wall 12 of the cap 3. The cap is substantially non-deformable, so fitting of the cap to the base involves the inward deflection of the lugs 9 by a camming action as the cap is pressed down on to the base. This is achieved by means of a hand-operated toggle press, since the force required is substantially greater than can be exerted by hand alone. The cap 3 has a post 13 therein extending downwardly from the top internal surface 14 of the cap. The post 13 serves to press the cable 8 firmly on to the pins 4 to ensure that electrical contact is achieved and maintained. The post 13 has tapered or conical sections 15, which apply an outward camming action on the lugs 9, leading to short cylindrical segments 16, which form the retaining means, of a diameter such as to be an interference fit within the lugs 9, ensuring that they cannot move inwardly when the cap has been fitted. The length downwardly of the cylindrical portion 16 is such as to permit it just to engage the lugs when the cap has been fitted, but not so long as to prevent the lugs from engaging fully in the groove 11. This configuration ensures that the cap becomes permanently locked on to the base and cannot therefore be removed to permit access to the electrical connections within it.

The base 2 and cap 3 of the lamp holder 1 are locked in place by the virtue of the fact that the flexible lugs 9 are entirely contained within the structure, with the substantially non-deformable cap 3 forming an external barrier. The use of the retaining means 14 advantageously permits a greater latitude in design. For example, the lamp holder may be square or rectangular viewed in a plane through the cable, with separate lug sections along each side. In, addition, the cross sectional structure of the lamp holder may be reversed, with the cap containing the lugs 9, and the base, through which the pins pass, containing the substantially non-deformable groove 11.

It is also to be appreciated that the use of the retaining means may allow the channel 31 for the cable 8 to be in the component containing the groove 11. This design option requires longer lugs 9, so as to keep the groove unbroken by the channel, and so substantially non-deformable. Longer lugs 9 have greater flexibility, but the use of the retaining means 14 will keep the lugs 9 locked in place.

Therefore, it is to be appreciated that the embodiments of the invention are not limited to the arrangement of FIG. 1, groove in cap and channel in base, but encompass also the other three possibilities: groove in cap and channel in cap; groove in base and channel in cap; and groove in base and channel in base. Similarly, although it is preferable to have the channel substantially in one portion in order to use a flat unbroken gasket, the channel may be divided between the cap and base.

The globe 17 coveting the lamp 6 is formed of transparent plastics material with a neck portion 18 having a circumferential channel 19 into which two robber O-rings 20 can be fitted. The neck portion 18 can then be pushed into a socket 21 formed in the lower part of the base 2, with the O-rings in sealing contact with the inner surface of a downwardly depending skirt portion 22 of the base, which defines the socket 21. The skirt 22 is thicker near to its free end to assist in retaining the globe and the circumferential channel is similarly tapered to be parallel to the skirt. The lamp is thus contained in a pressure-tight enclosure, ensuring that it is fully protected from atmospheric moisture.

Figure 2:
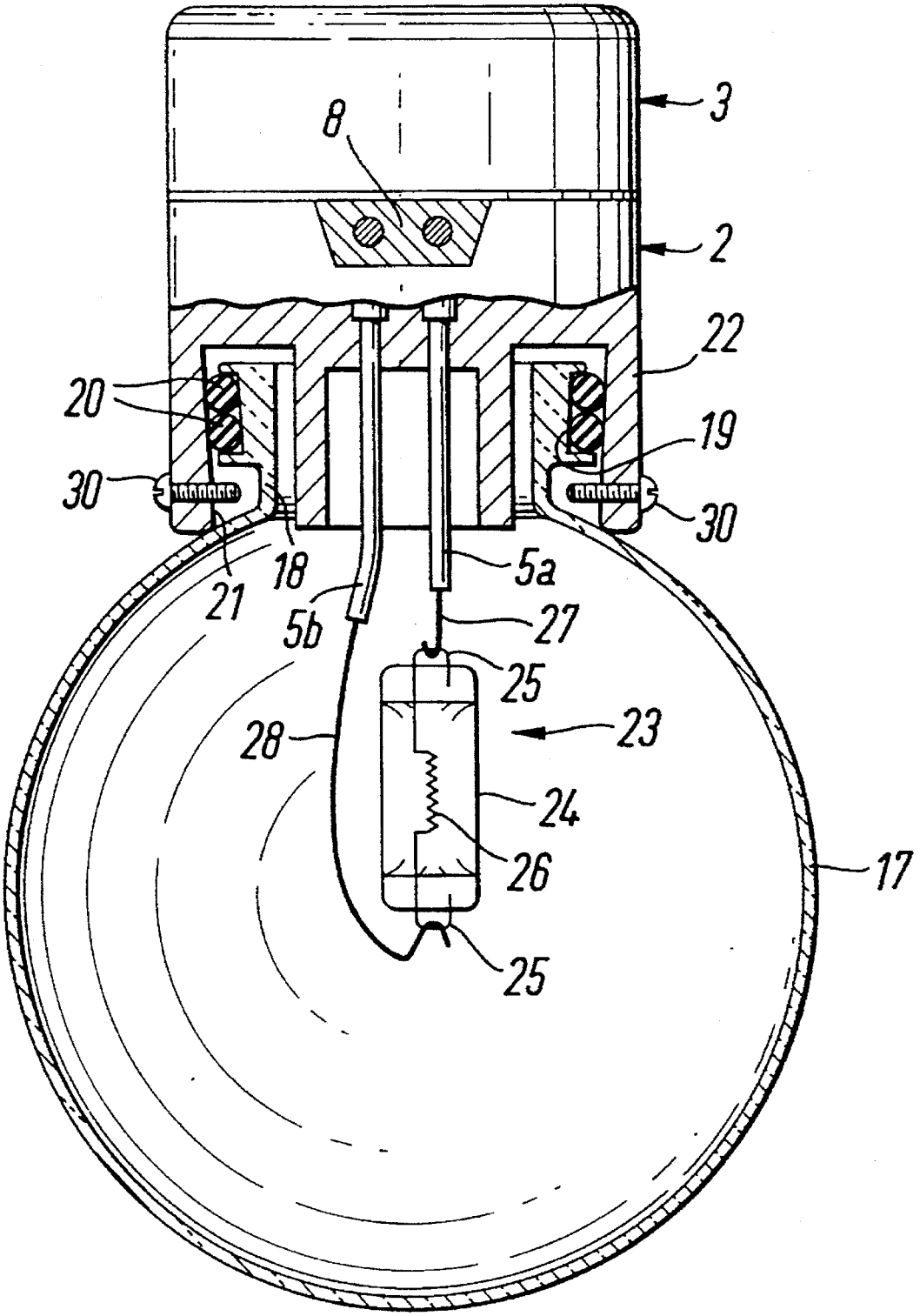
FIG. 2 is a part sectional elevation of a lamp holder according to a second embodiment of the invention.
Figure 3:
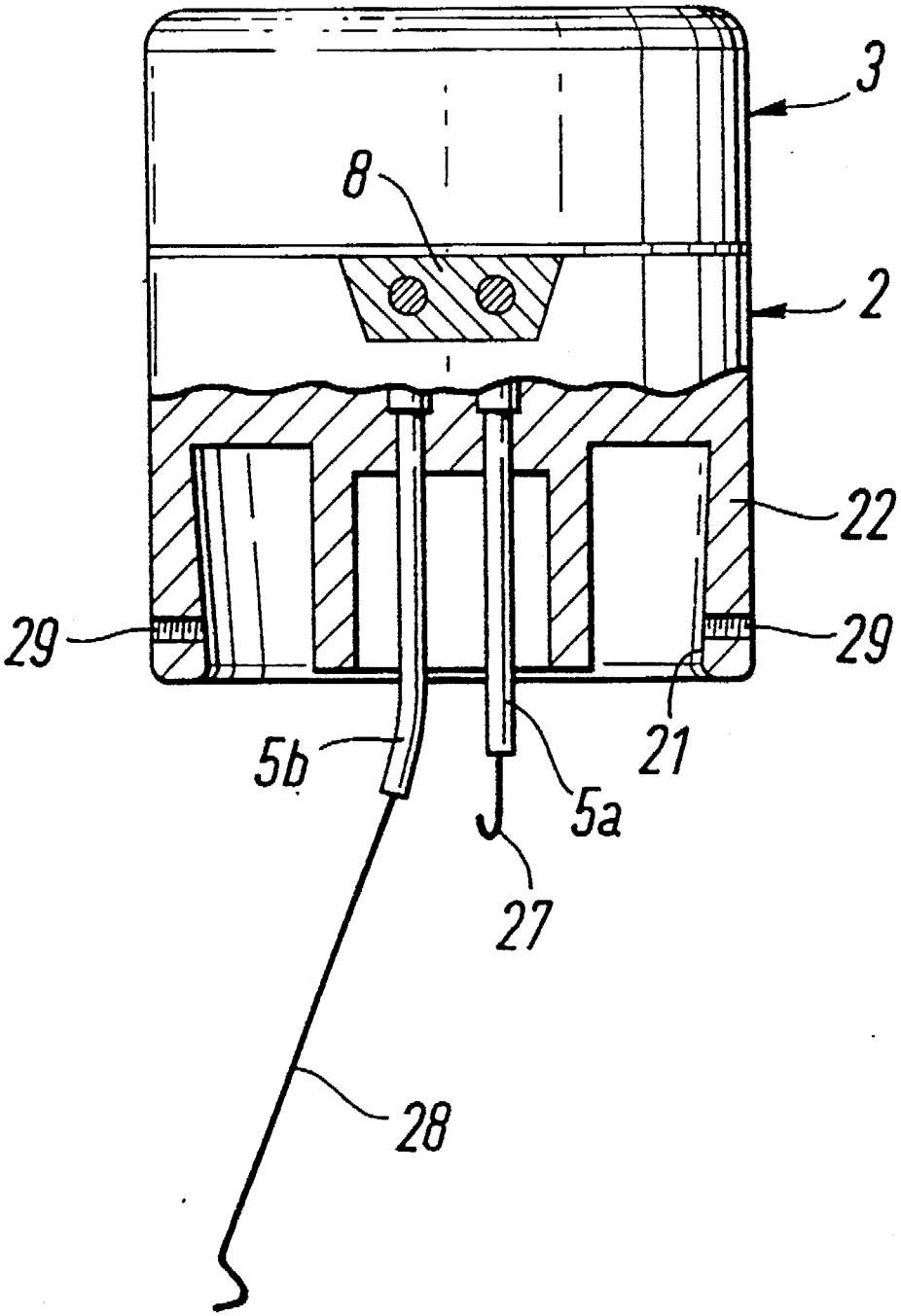
FIG. 3 is a part sectional elevation of the lamp holder shown in FIG. 2, before installation of the lamp and the coveting globe.

Referring now to FIGS. 2 and 3, the lamp is a low voltage xenon-filled bulb or lamp 23 having a generally cylindrical envelope 24 flattened at each end to form a seal around a wire loop 25 in each end of the lead for the electrical filament 26 of the lamp 23. The lamp is connected to the tubular contact 5 of the lamp holder as follows. The first tubular contact **5*a* is shortened in length relative to the other contact 5*b* and a short wire hook 27 is held therein by means of crimping. The other tubular contact 5*b* is befit slightly away from the first and has a long spring wire 28 similarly secured therein. In its relaxed state, as shown in FIG. 3, the long wire 28 is generally straight. To fit the lamp 23, one of the loops 25 is engaged with the hook 27 while the wire 28 is bent over so that the hook at its free end can engage the loop 25 at the other end of the lamp. In this position, the wire 28 acts as a spring tending to pull the lamp outwardly relative to the first hook 27, thus ensuring that the lamp is held firmly in contact with the electrical contacts, the springiness of the wire 28 helping to protect the bulb against any shock. The wire 28** is suitably formed from hard stainless steel, but may also be formed of materials such as phosphor-bronze or even titanium or an alloy of titanium.

Figure 4:
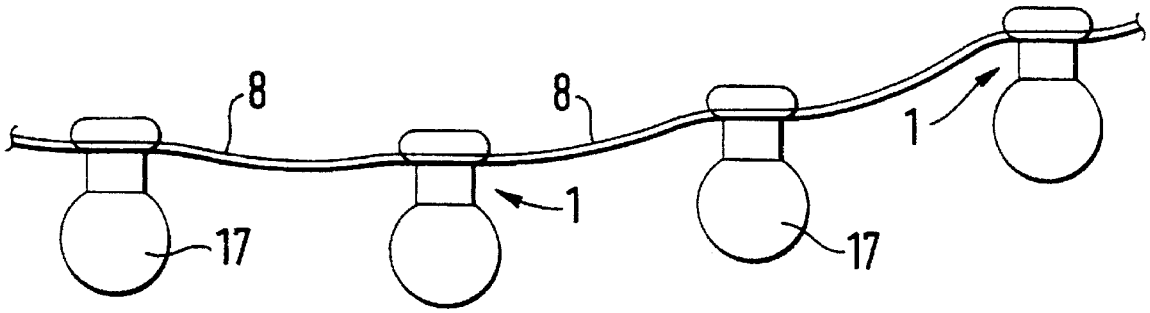
FIG. 4 illustrates a plurality of lamp holders attached to and separated along an insulated electrical power supply cable.

FIGS. 2 and 3 also illustrate another feature of this embodiment of the invention. Although the globe in normally held firmly in place by friction between the rubber O-rings 20 and the inside of the skirt portion 22, it is sometimes possible for vandals to pull the globes off and to damage the lamp. To guard against this possibility, where the lamp holder is installed within the reach of the ground, diametrically-opposed threaded screw holes 29 are formed through the lower part of the skirt, and small retaining screws 30 are fixed into these to provide stops for the circumferential channel 19 on the neck portion 18 of the globe 17. As illustrated in FIGS. 2 and 3, the holes 29 are positioned at right angles to the direction of the cable 8, for convenience of illustration. However, in practice it will be desirable to place the screw holes 29 and the screws 30 in line with the cable so that they are less readily seen. FIG 4 illustrates a plurality of lamp holders 1 attached to and separated along an insulated electrical power supply cable 8.

What I claim is:

1. A lamp holder comprising a base and two electrical contacts for forming a connection with a bulb, characterized in that the bulb comprises an envelope around an electrical filament with two wires extending therefrom each passing through the envelope and each forming a loop protruding from the envelope, the two loops being at opposed ends of the envelope, wherein each electrical contact has a wire with a hook at its free end formed to engage one of the two loops, a shorter one of wires engaging the one of said two loops at the nearer end of the bulb, and the other longer spring wire engaging the other of said two loops at the far end of the bulb in a manner that induces a spring tension in the spring wire, so holding the bulb suspended between the two hooks and in electrical contact therewith.

2. A lamp holder according to claim 1, wherein the spring wire is formed from stainless steel.

3. A lamp holder according to claim 1 wherein the spring wire is formed from phosphor-bronze.

4. A lamp holder according to claim 1 wherein the spring wire is formed from titanium.

5. A lamp holder according to claim 1 wherein the spring wire is formed from an alloy of titanium.

6. A festoon lighting system having a plurality of lamp holders attached to and separated along an insulated electrical power supply cable, each holder comprising a base and two electrical contacts for forming a connection with a bulb, characterized in that the bulb comprises an envelope around an electrical filament with two wires therefrom each passing through the envelope and each forming a loop protruding therethrough, wherein each electrical contact has a wire with a hook at its free end formed to engage one of the two loops, so that the short wire engages the nearer end of the bulb, and the other longer spring wire engages the far end of the bulb in a manner that induces a spring tension in the spring wire, so retaining each hook within its respective loop.

* * * * *